US009938989B2

(12) United States Patent
Vardar et al.

(10) Patent No.: US 9,938,989 B2
(45) Date of Patent: Apr. 10, 2018

(54) EVAPORATING FAN CASE FIXING SYSTEM FOR A REFRIGERATOR

(71) Applicant: ARCELIK ANONIM SIRKETI, Istanbul (TR)

(72) Inventors: Osman Vardar, Istanbul (TR); Umud Yazgan, Istanbul (TR); Fahri Kirli, Istanbul (TR); Yigit Ozsacmaci, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 325 days.

(21) Appl. No.: 14/655,327

(22) PCT Filed: Dec. 24, 2012

(86) PCT No.: PCT/EP2012/076889

§ 371 (c)(1),
(2) Date: Jun. 24, 2015

(87) PCT Pub. No.: WO2014/101936

PCT Pub. Date: Jul. 3, 2014

(65) Prior Publication Data

US 2015/0322967 A1 Nov. 12, 2015

(51) Int. Cl.
*F04D 19/00* (2006.01)
*F04D 29/64* (2006.01)
(Continued)

(52) U.S. Cl.
CPC ..... *F04D 29/646* (2013.01); *F04D 19/002* (2013.01); *F04D 25/0613* (2013.01);
(Continued)

(58) Field of Classification Search
None
See application file for complete search history.

(56) References Cited

U.S. PATENT DOCUMENTS 4,568,243 A 2/1986 Schubert et al.
5,208,730 A * 5/1993 Tracy ..... F04D 29/668 361/679.48

(Continued)

FOREIGN PATENT DOCUMENTS

DE 202005012627 U1 10/2006
DE 102009027881 A1 1/2011

(Continued)

OTHER PUBLICATIONS

International Search Report and written opinion of WO2014/101936 A1 ( and references cited therein).

*Primary Examiner* — Woody Lee, Jr.
*Assistant Examiner* — Theodore Ribadeneyra
(74) *Attorney, Agent, or Firm* — Kilpatrick Townsend & Stockton LLP

(57) ABSTRACT

The present invention pertains to a fan assembly for a refrigerator. Said assembly comprises a fan with a first and a second outer wall at two ends along axial direction of said fan. Said outer walls extend perpendicular to said axial direction of said fan. Said fan assembly comprises a wall element which delimits an evaporator within said refrigerator. Said wall element has a fan mounting opening with projecting edges in the direction of said fan, said fan assembly further comprising an isolator and a locking element.

18 Claims, 1 Drawing Sheet

(51) Int. Cl.

| | |
|---|---|
| ***F04D 29/52*** | (2006.01) |
| ***F04D 29/32*** | (2006.01) |
| ***F25D 17/06*** | (2006.01) |
| ***F04D 25/06*** | (2006.01) |
| ***F04D 29/60*** | (2006.01) |
| ***F04D 29/66*** | (2006.01) |

(52) U.S. Cl.
CPC ..... *F04D 29/325* (2013.01); *F04D 29/522* (2013.01); *F04D 29/601* (2013.01); *F04D 29/668* (2013.01); *F25D 17/062* (2013.01); *F25B 2500/12* (2013.01); *F25D 2317/0681* (2013.01)

(56) References Cited

U.S. PATENT DOCUMENTS

2003/0035724 A1* 2/2003 Chen ..... F04D 29/646 415/213.1
2007/0020120 A1 1/2007 Oh et al.
2007/0095089 A1 5/2007 Rafalovich et al.
2007/0193280 A1* 8/2007 Tuskiewicz ..... A47F 3/0404 62/3.6
2008/0030949 A1* 2/2008 Hsiao ..... G06F 1/203 361/689
2008/0253886 A1* 10/2008 Chen ..... F04D 29/601 415/213.1
2009/0290306 A1* 11/2009 Zhao ..... F04D 25/0613 361/695
2010/0002375 A1* 1/2010 Yao ..... F04D 25/0613 361/679.49
2011/0070080 A1* 3/2011 Peng ..... F04D 19/007 415/214.1

FOREIGN PATENT DOCUMENTS

DE 202009015068 U1 3/2011
WO 03089858 A1 10/2003

* cited by examiner

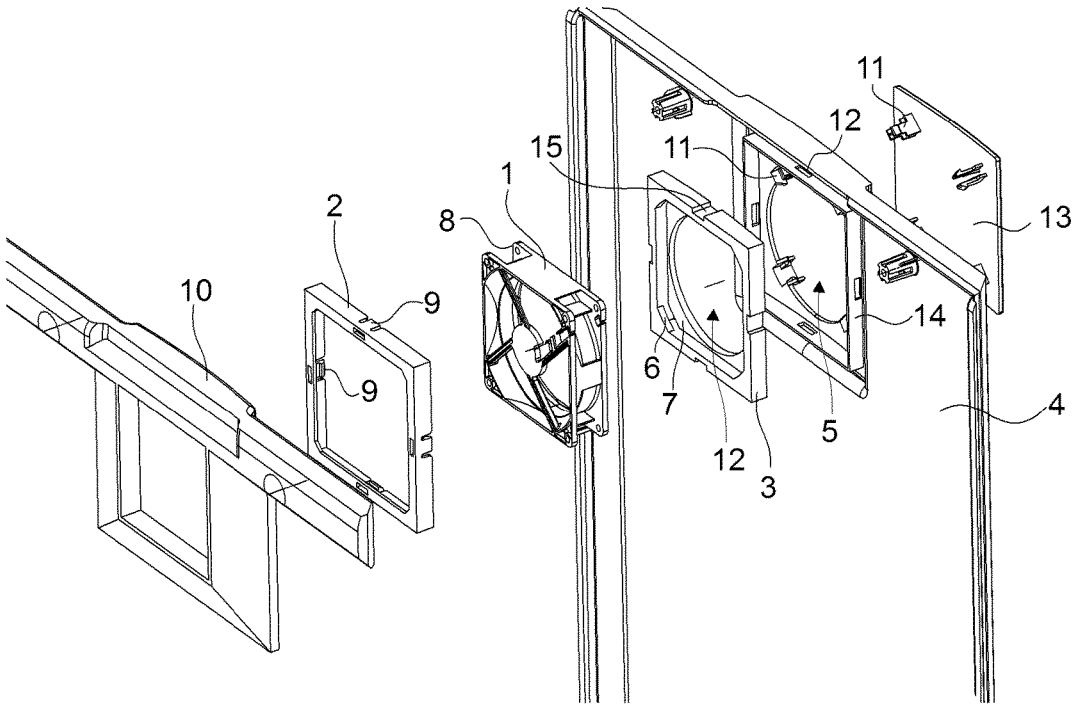
11
12
15
11
1
2
8
13
10
9
14
9
6
7
4
5
12
3

EVAPORATING FAN CASE FIXING SYSTEM FOR A REFRIGERATOR

The present invention pertains to a square shaped fan case fixing system in an evaporator. More specifically, the present invention pertains to a system by which a square shaped case of a fan is locked in a more secure manner.

A refrigerator comprises an evaporator disposed in a compartment thereof, a compressor fluidly connected with said evaporator moving refrigerant therethrough in the meantime and an evaporator fan moving air over the evaporator.

Use of an evaporator fan having a square case within which the fan itself is disposed is widely practiced. This typically entails fixing of said fan case in the fan slot on the evaporator. Among others, a patent disclosure in the technical field of the present invention may be referred to as US 2007/095089 disclosing an evaporator assembly with an evaporator fan located in a refrigeration compartment of the refrigerator.

The evaporator assembly according to the present invention features a more silently functioning fan as it eliminates any physical contact involving rigid elements. This stems from the fact that the fan of the invention is secured in a substantially enhanced manner such that it is homogenously locked at all edges and corners. Further, mounting of the system is significantly simplified and rendered easier in terms of the number of mechanical parts and need for tools required in this effect.

The present invention provides an evaporator assembly as defined in the characterizing portion of claim 1.

Primary object of the present invention is to provide an evaporator assembly for a refrigerator having a more silently functioning fan.

The present invention proposes a fan assembly for a refrigerator. Said assembly has a fan in a fan case, said case having two end parts in the form of outer walls, each facing said fan's operation plane. Said fan assembly has a wall element for delimiting an evaporator in said refrigerator. Accordingly said wall element provides the outer wall of said refrigerator. It has a fan mounting opening with inwardly bent edges facing said fan.

An isolator and a fan locking element are provided to effect secure fixing of said fan. Said isolator has internal cavities into which an outer wall of said fan case can be snugly fit. In this configuration, said outer wall is supported on both surfaces thereof in a contact relationship by said isolator and especially all corners thereof are laterally enclosed.

A locking means interlocks with said projecting edges such that said isolator provides a physical barrier between said outer wall and other parts, i.e. said wall element and said locking means.

Said fan has a square-shaped case and so shaped are said isolator and said projecting edges. Said isolator's outer surfaces in radial directions around the axis of said fan are fully covered by said projecting edges of said wall element.

Each of said projecting edges has a locking opening in the middle with which a locking end of said locking element interlocks. In this position, said locking element at least partially encloses said projecting edges, the latter in return enclosing said isolator.

The other outer wall of said fan that is facing inner space of said refrigerator is enclosed by a polystyrene member in its entirety.

Accompanying drawings are given solely for the purpose of exemplifying an evaporator assembly for a refrigerator whose advantages were outlined above and will be explained hereinafter in brief. The drawings are not meant to delimit the scope of protection as identified in the claims nor should they be referred to alone in an effort to interpret the scope identified in said claims without recourse to the technical disclosure in the description of the present invention.

FIG. 1 demonstrates a general perspective view of dismantled parts of an evaporator assembly for a refrigerator according to the present invention.

Referring now to the FIGURE outlined above, the present invention proposes an evaporator assembly as defined in claim 1.

The following numerals are assigned to different parts demonstrated in the drawings:

(1) Fan case
(2) Locking element
(3) Isolator
(4) Wall element
(5) Mounting opening
(6) Corner support
(7) Circular abutment
(8) Outer wall
(9) Locking end
(10) Polystyrene member
(11) Fastening members
(12) Locking opening
(13) Fan cover
(14) Projecting edges
(15) Channel The present invention proposes a fan assembly for a refrigerator, said assembly comprising a fan case (1) with a first and a second outer wall (8) at two ends along axial direction of said fan and perpendicular thereto. Said outer walls (8) are designed in the form of thin plates with a certain thickness.

Said fan assembly comprises a wall element (4) for delimiting an evaporator in said refrigerator. Said wall element (4) has an mounting opening (5) suitable for mounting said fan. It further has projecting edges (14) in the direction of said fan, said projecting edges (14) partially enclosing said fan.

Said fan assembly according to the present invention further comprises an isolator (3) and a locking element (2) for securely fixing said fan whose operation is accordingly rendered substantially more silent.

Said isolator (3) comprises a first abutment means against which said first outer wall (8) of said fan is leanable such that a second abutment means of said isolator (3) confines said first outer wall (8) within said isolator (3). This provides that said first outer wall (8) of said fan case is physically separated from said wall element (4), thereby eliminating physical contact of rigid parts.

Further, said locking element (2) according to the present invention is engageable with said projecting edges (14) such that a homogenous locking where physical parts engage with each other in a mutual manner is obtained.

Said fan case (1) has a square-shaped form and said locking element (2) as well as said isolator (3) have a corresponding shape for securely fixing said fan.

Said first abutment means according to the invention is a circular abutment (7) supporting outer surface of said first outer wall (8) in a contact relationship. This provides that a large contact area is obtained throughout the surface of said circular abutment (7) which leans against said fan and accordingly vibrations are evenly distributed and a less noisy operation is obtained.

Further, said second abutment means is a corner support (6) supporting inner surface corners of said first outer wall (8) in a contact relationship. This provides that corner portions of said first outer wall with a certain thickness are squeezed and confined between said circular abutment (7) and said corner supports (6) such that any vibration produced by said fan is evenly dispersed at four corners of said first outer wall (8).

Said isolator's (3) outer surfaces extending parallel to the axial direction of said fan are fully enclosed by said projecting edges (14) of said wall element (4). This provides that a full enclosure is provided whereby said isolator (3) is kept in its position. This is important as the original position of said isolator (3) ensures that said fan is supported in a balanced manner during operation.

According to the present invention, said projecting edges (14) of said wall element (4) comprise a locking opening (12) with which a locking end (9) of said locking element (2) is engageable such that said projecting edges (14) are at least partially enclosed by said locking element (2). Therefore, said locking element (2) presses on said projecting edges (14) in a manner symmetrically interlocked at a plurality of locations.

To this end, said projecting edges (14) are designed with a square shaped profile with each edge having a locking opening (12) lockable by a locking end (9) of said locking element (2). Said second outer wall (8) of said fan is enclosable by a polystyrene member.

The other outer wall (8), i.e. the second outer wall (8) of said fan that is facing inner space of said refrigerator is enclosed by a polystyrene member (10) in its entirety. Said wall element's (4) mounting opening (5) is covered by a fan cover (13) having fastening members (11) for engaging with respective members on said wall element (4).

Said isolator (3) has a channel (15) on every edge thereof. Said channels (15) are used for removing said locking element (2) in allowing access into the same with a sharp tool such as a screwdriver.

The invention claimed is:

1. A fan assembly for a refrigerator, said assembly comprising a fan case with a first and a second outer wall at two ends along axial direction of said fan and perpendicular thereto, said fan assembly comprising a wall element for delimiting an evaporator in said refrigerator, said wall element having a mounting opening suitable for mounting said fan and projecting edges in the direction of said fan, said fan assembly further comprising an isolator and a locking element characterized in that; said isolator comprises a first abutment means against which said first outer wall of said fan is leanable such that a second abutment means of said isolator confine said first outer wall within said isolator and, said locking element is engageable with said projecting edges such that said isolator physically separates said first outer wall from said wall element and said locking element, wherein said first abutment means is a circular abutment supporting outer surface of said first outer wall in a contact relationship.

2. The fan assembly for a refrigerator as set forth in claim 1 wherein said fan case has a square-shaped form.

3. The fan assembly for a refrigerator as set forth in claim 1 wherein said second abutment means is a corner support supporting inner surface corners of said first outer wall in a contact relationship.

4. The fan assembly for a refrigerator as set forth in claim 1 wherein outer surfaces of said isolator extending parallel to the axial direction of said fan are fully enclosed by said projecting edges of said wall element.

5. The fan assembly for a refrigerator as set forth in claim 1, wherein said projecting edges comprises a locking opening with which a locking end of said locking element is engageable such that said projecting edges are at least partially enclosed by said locking element.

6. The fan assembly for a refrigerator as set forth in claim 5 wherein said projecting edges are designed in the form of a square with each edge having a locking opening lockable by a locking end of said locking element.

7. The fan assembly for a refrigerator as set forth in claim 1 wherein said second outer wall of said fan is enclosable by a polystyrene member in its entirety.

8. The fan assembly for a refrigerator as set forth in claim 2, wherein said first abutment means is a circular abutment supporting outer surface of said first outer wall in a contact relationship.

9. The fan assembly for a refrigerator as set forth in claim 2, wherein said second abutment means is a corner support supporting inner surface corners of said first outer wall in a contact relationship.

10. The fan assembly for a refrigerator as set forth in claim 8 wherein said isolator's outer surfaces extending parallel to the axial direction of said fan are fully enclosed by said projecting edges of said wall element.

11. The fan assembly for a refrigerator as set forth in claim 9 wherein said isolator's outer surfaces extending parallel to the axial direction of said fan are fully enclosed by said projecting edges of said wall element.

12. The fan assembly for a refrigerator as set forth in claim 3, wherein said projecting edges comprises a locking opening with which a locking end of said locking element is engageable such that said projecting edges are at least partially enclosed by said locking element.

13. The fan assembly for a refrigerator as set forth in claim 9, wherein said projecting edges comprises a locking opening with which a locking end of said locking element is engageable such that said projecting edges are at least partially enclosed by said locking element.

14. The fan assembly for a refrigerator as set forth in claim 4, wherein said projecting edges comprises a locking opening with which a locking end of said locking element is engageable such that said projecting edges are at least partially enclosed by said locking element.

15. The fan assembly for a refrigerator as set forth in claim 11, wherein said projecting edges comprises a locking opening with which a locking end of said locking element is engageable such that said projecting edges are at least partially enclosed by said locking element.

16. The fan assembly for a refrigerator as set forth in claim 5, wherein said second outer wall of said fan is enclosable by a polystyrene member in its entirety.

17. The fan assembly for a refrigerator as set forth in claim 12, wherein said second outer wall of said fan is enclosable by a polystyrene member in its entirety.

18. The fan assembly for a refrigerator as set forth in claim 14, wherein said second outer wall of said fan is enclosable by a polystyrene member in its entirety.

* * * * *